US005683025A

United States Patent [19]

Grendol

[11] Patent Number: 5,683,025

[45] Date of Patent: Nov. 4, 1997

[54] APPARATUS FOR DISPENSING INDIVIDUAL PLASTIC FASTENERS FROM FASTENER STOCK

[75] Inventor: Clark L. Grendol, Sturbridge, Mass.

[73] Assignee: Avery Dennison Corporation, Pasadena, Calif.

[21] Appl. No.: 646,749

[22] Filed: May 3, 1996

[51] Int. Cl.[6] ..... B25C 1/00

[52] U.S. Cl. ..... 227/67

[58] Field of Search ..... 227/67, 71

[56] References Cited

U.S. PATENT DOCUMENTS

| | | | |
|---|---|---|---|
| 4,456,162 | 6/1984 | Furutsu | 227/67 |
| 4,553,688 | 11/1985 | Furutsu | 227/67 |
| 4,651,913 | 3/1987 | Bone | 227/67 |
| 5,074,452 | 12/1991 | Bone | 227/67 |
| 5,433,366 | 7/1995 | Deschenes et al. | 227/67 |
| 5,497,930 | 3/1996 | Kubota | 227/67 |

*Primary Examiner*—Scott A. Smith
*Attorney, Agent, or Firm*—Kriegsman & Kriegsman

[57] ABSTRACT

An apparatus for dispensing plastic fasteners from a clip of fastener stock, each fastener having a cross bar coupled to a common runner bar by a stub. The apparatus includes a gun shaped casing made of plastic. A hollow needle having an inlet opening and an outlet opening is mounted on the front of the casing. A guide groove is formed in the casing for receiving the fastener stock, the guide groove being in communication with the inlet opening of the hollow needle. The guide groove includes a stub receiving portion bounded by a front wall. The apparatus also includes a feed member mounted on the casing behind the guide groove. The feed member includes a tooth having a lower surface which engages the stub of an individual fastener to advance the fastener stock so that the cross bar of the fastener to be dispensed is advanced into alignment with the inlet opening of the hollow needle. The guide groove includes a protrusion on the front wall of the stub receiving portion which positions the stub of the individual fastener in engagement with the tooth of the feed member directly underneath the lower surface of the tooth so that the fastener will not become wedged between the tooth and front wall of the guide groove. The cross bar of the fastener to be dispensed is pushed out through the outlet opening of the needle by an ejector rod.

6 Claims, 5 Drawing Sheets

APPARATUS FOR DISPENSING INDIVIDUAL PLASTIC FASTENERS FROM FASTENER STOCK

BACKGROUND OF THE INVENTION

The present invention relates to an apparatus for dispensing individual plastic fasteners from fastener stock.

Plastic fasteners having a cross bar at one end, a paddle at the other end and a thin filament or cross-link connecting the two ends are well known in the art and widely used in commerce to attach labels, price tags or other items to articles in a manner which minimizes the risk of inadvertent detachment therefrom. Typically, such plastic fasteners are manufactured in the form of fastener stock, the fastener stock being produced by molding or stamping from flexible plastic materials, such as nylon, polyethylene, and polypropylene.

In one known type of fastener stock, the cross bar end of each fastener is connected by a stub to a runner bar to form a clip of fasteners. In another known type of fastener stock, often referred to as ladder stock, a pair of elongated side members are interconnected by a plurality of cross links or filaments. One of the side members is shaped to define a plurality of cross bars which are joined together by short severable connectors, the connectors being defined by indentations or notches formed along the side member. The other side member is shaped to define a plurality of paddles.

Additional information pertaining to fastener stock may be found in U.S. Pat. No. 4,955,475 issued Sep. 11, 1990; U.S. Pat. No. 4,456,161, issued Jun. 26, 1984; U.S. Pat. No. 4,121,487, issued Oct. 24, 1978; U.S. Pat. No. 3,470,834, issued Oct. 7, 1969 and U.S. Pat. No. 3,103,666, issued Sep. 17, 1963.

The dispensing of individual fasteners from fastener stock is often accomplished with an apparatus commonly referred to as a "tagger gun". Typically, a tagger gun is a hand held trigger operated device which is constructed to accept fastener stock in a guide groove formed in the body of the gun. Tagger guns usually include a mechanism for feeding the cross bar end of an individual fastener in the fastener stock inserted into the guide groove into alignment with the longitudinal axis of a hollow needle at the front end of the gun and a mechanism for pushing the cross bar end of the fastener through the hollow needle and then out through the tip of the hollow needle. Some tagger guns are manually operated while other tagger guns are powered by an electric motor.

Tagger guns have been developed and are in use with both of the above described types of fastener stock.

In U.S. Pat. No. 4,651,913, which patent is incorporated herein by reference, there is disclosed a fastener dispensing tool for use with a clip of fasteners. The tool includes a frame having a guide groove and a unitary, single tooth feed member for advancing the fastener stock in the guide groove to bring the forwardmost fastener in line with a hollow slotted needle. The tooth portion of the feed member has an upper surface defining an angle with respect to the axis of the installed clip, when the feed member is in an advanced position, and a lower surface approximately perpendicular to the axis of the clip. To prevent the fastener clip from moving upwards during cycling of the feed member, an anti-back member is provided.

In U.S. Pat. No. 5,074,452, which patent is also incorporated herein by reference, there is disclosed another fastener dispensing tool for use with a clip of fasteners. The tool includes a frame having a guide groove and an ejector rod which is advanced by a trigger operated lever. The ejector rod is provided to sever an individual fastener from a clip of fasteners and dispense the severed fastener through a hollow slotted needle. The tool also incorporates a unitary, single-tooth feed member for advancing the fastener clip in the guide groove to bring the forwardmost fastener in line with the needle. Such feed member comprises a reciprocally mounted body integral with a U-shaped resilient finger terminating in a feed tooth. The feed member together with its resilient feed finger moves linearly in order to engage and advance the fastener assemblage, while the finger flexes during a return motion in order to clear a succeeding fastener in the clip.

It has been found that tagger guns of the type such as described in U.S. Pat. No. 4,651,913 and U.S. Pat. No. 5,074,457 may, on occasion, become jammed as the feed member advances the fastener clip to bring the cross-bar of the forwardmost fastener in line with the needle. Specifically, oftentimes the lowermost fasteners in the fastener clip will become positioned along the front wall of the guide groove. As a consequence, when the feed member is rotated counterclockwise to advance the lowermost fastener in line with the needle, the stub of the lowermost fastener will align at the tip of the tooth of the feed member, rather than directly underneath the lower surface of the tooth of the feed member as desired. With the lowermost stub positioned at the tip of the tooth of the feed member, the tooth tends to push the stub down as well as in towards the front wall of the guide groove. Displaced at such an angle, the lowermost fastener will often become wedged in between the tooth of the feed member and the front wall of the guide groove. Wedged as such, the feed member can not advance the lowermost fastener directly down and in line with the needle as required for proper ejectment. Instead, with the lowermost fastener wedged between the tooth of the feed member and the front wall of the guide groove, the apparatus will become jammed, precluding further use.

SUMMARY OF THE INVENTION

It is an object of the present invention to provide a new and improved apparatus for dispensing plastic fasteners from a clip of fasteners.

It is yet another object of the present invention to provide an apparatus as described above in which a fastener clip is received in a guide groove and is advanced down into alignment with a hollow needle by a unitary single tooth feed member.

It is still another object of the present invention to provide an apparatus as described above which properly positions a fastener for ejectment while simultaneously preventing unwanted back-up of the fastener stock.

It is yet another object of the present invention to provide an apparatus as described above in which the likelihood of the individual plastic fasteners becoming jammed as they are dispensed is decreased.

Accordingly, there is provided an apparatus for dispensing plastic fasteners from a clip of fastener stock, the fastener stock comprising a clip of fasteners, each individual fastener having a cross bar coupled to a common runner bar by a stub, said apparatus comprising a casing, a hollow needle mounted on said casing, said hollow needle having an inlet opening and an outlet opening, a guide groove formed in said casing for receiving the fastener stock, said guide groove being in communication with the inlet opening of said hollow needle, said guide groove having a stub receiving portion, said stub receiving portion being bounded by a front wall, a feed member mounted on said casing, said feed member comprising a tooth having a lower surface, said tooth being engageable with the stub of an individual fastener to advance the fastener stock loaded into said guide groove so that the cross bar of a fastener to be dispensed is advanced into alignment with the inlet opening of said hollow needle, a protrusion on the front wall of the stub receiving portion of said guide groove, said protrusion positioning the stub of the individual fastener in engagement with the tooth directly underneath the lower surface of the tooth when said feed member advances the fastener stock, and an ejector rod for pushing the cross bar of the fastener to be dispensed out through the outlet opening of said needle.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

Figure 2:
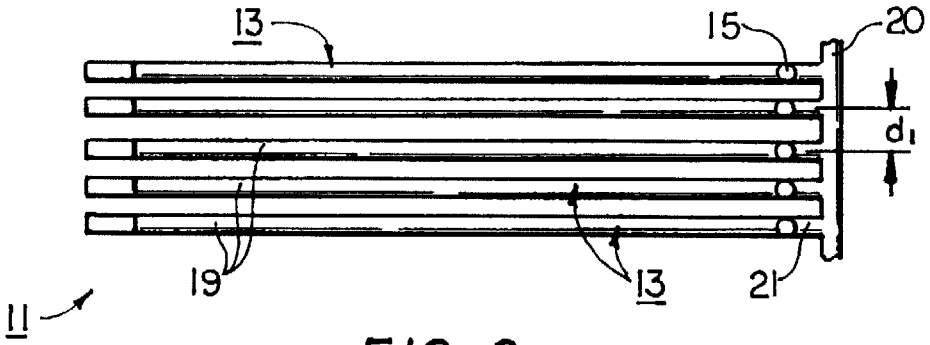
FIG. 2 is a front view of the clip of fastener stock of FIG. 1.
Figure 3:
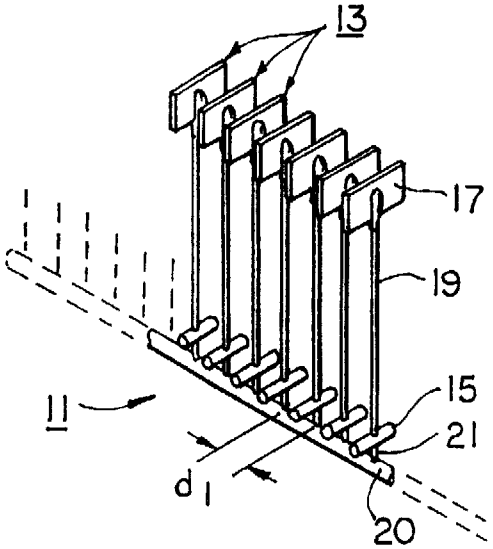
FIG. 3 is a perspective view, broken away in part, of the clip of fastener stock of FIG. 1.
Figure 1:
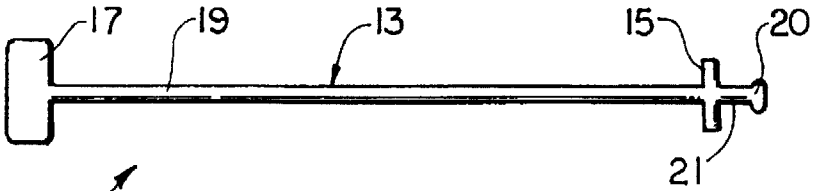
FIG. 1 is a side view of a clip of fastener stock which may be used with the apparatus of this invention.

Referring to the drawings, there are shown in FIGS. 1–3, side, front and perspective views, respectively, of a clip of fastener stock, the clip of fastener stock being identified by reference numeral 11. As can be seen, fastener stock 11, also commonly referred to as a fastener assemblage, includes a plurality of individual fasteners 13. Each fastener 13 comprises a first end which is shaped to define a cross bar 15, a second end which is shaped to define a paddle 17, and a thin filament 19 which interconnects cross-bar 15 and paddle 17. Each fastener 13 is coupled to a common runner bar 20 by a short connector filament or stub 21 at the cross bar 15 of fastener 13. Clip 11 is made of a plastic material such as nylon, polyethylene or polypropylene.

The distance $d_1$ between successive stubs 21 represents the "pitch" of fastener stock 11. The pitch of fastener assemblages typically ranges from 0.04 inches to 0.15 inches (1–4 mm) in pitch.

Figure 4:
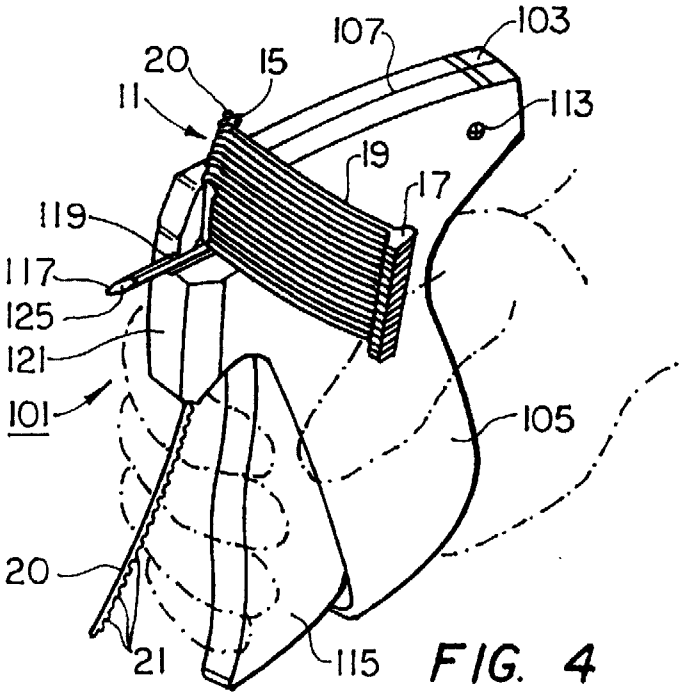
FIG. 4 is a perspective view of an apparatus constructed according to this invention, with a fastener clip installed.
Figure 5:
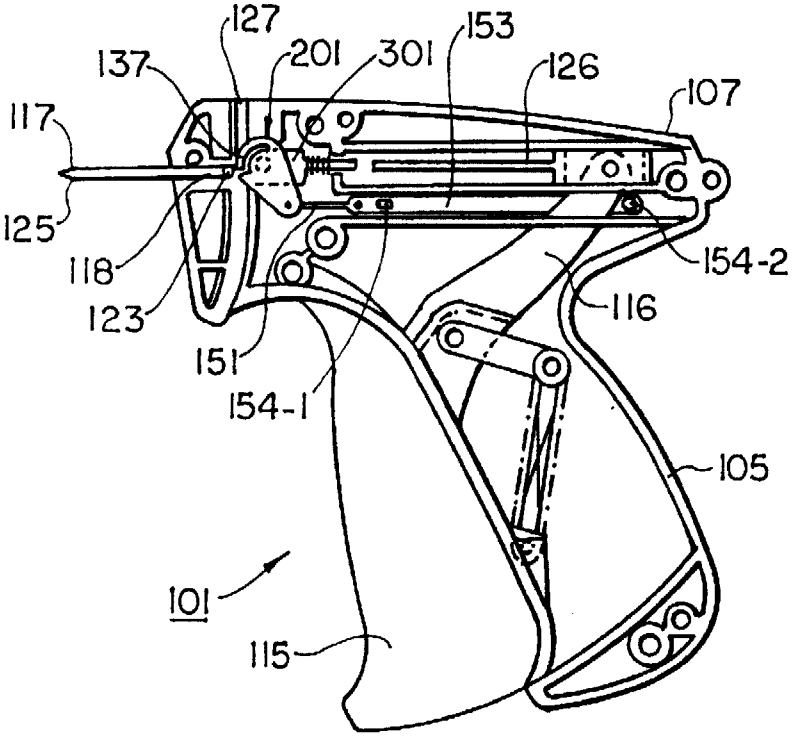
FIG. 5 is a view showing the internal construction of the apparatus in FIG. 4.

Referring now to FIGS. 4 through 7, there is shown in FIG. 4 a perspective view of an apparatus constructed according to this invention for dispensing plastic fasteners 13 from fastener stock 11, the apparatus being identified by reference numeral 101 and being shown with fastener clip 11 installed. A view of the internal construction of apparatus 101 is shown in FIG. 5.

Figure 6:
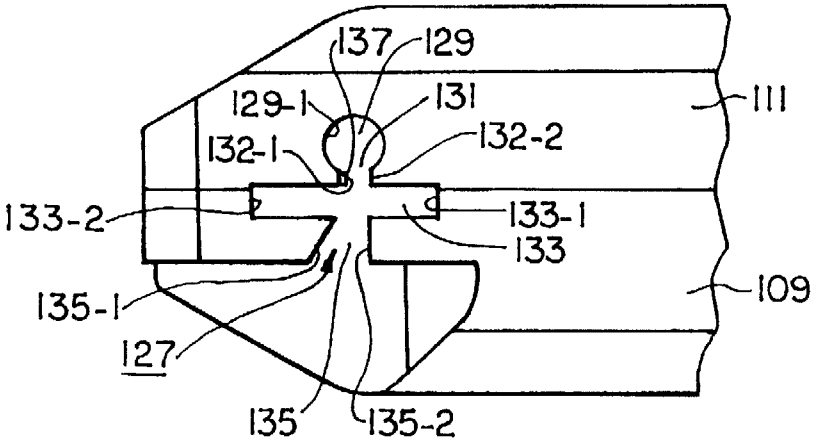
FIG. 6 is an enlarged fragmentary top view, broken away in part, of the apparatus shown in FIG. 4, without the hollow needle.

Apparatus 101 includes a hollow gun-shaped casing 103 having a handle portion 105 and a barrel portion 107. Casing 103, a top view of which is shown in FIG. 6, is formed of a right half 109 and a left half 111. Halves 109 and 111 may be fabricated from any convenient material, such as molded plastic and are joined together by screws 113. Alternatively, halves 109 and 111 may be joined together by a snap-fit, by sonic welding, by gluing, by riveting or the like. Apparatus 101 is hand actuated by a lever type trigger 115 located at the front of handle portion 105, trigger 115 being connected to a control lever 116.

A hollow needle 117 is removably mounted within a forwardly extending needle retaining groove 118 in barrel portion 107 and extends out through an opening 119 at the front end 121 of barrel portion 107. Needle 117 includes an inlet opening 123 for receiving the cross bar 15 of each individual fastener 13 and an outlet opening 125, in the shape of a pointed tip, through which each individual fastener 13 exits. Cross bar 15 of each individual fastener 13 is pushed out through needle 117 by an ejector rod 126 which is attached to control lever 116.

A downwardly extending guide groove 127 is formed in the top of barrel portion 107 into which fastener stock 11 is inserted. As shown in FIG. 6, guide groove 127 includes a common runner bar receiving portion 129 bounded by a curved wall 129-1 and through which common runner bar 20 is fed into, a stub receiving portion 131 bounded by a front wall 132-1 and a rear wall 132-2 and through which stub 21 is fed into, a cross bar receiving portion 133 bounded by a back wall 133-1 and a front wall 133-2 and through which cross bar 15 is fed into, and a thin filament receiving portion 135 bounded by a front wall 135-1 and a rear wall 135-2 and through which a portion of thin filament 19 is fed into. As can be seen, guide groove 127 is at an angle with needle retaining groove 118 and is in communication with inlet opening 123 of needle 117.

Apparatus 101 further includes a protrusion 137 on front wall 132-1 of stub receiving portion 131. Particular significance must be drawn to protrusion 137 and its function in the use of apparatus 101, which will be described below in great detail.

Figure 7:
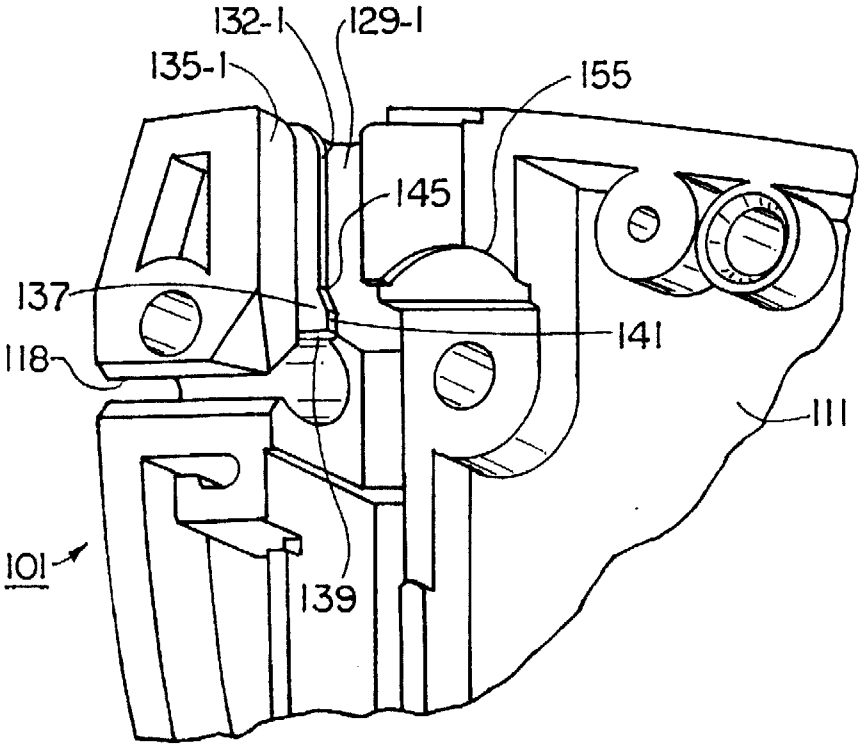
FIG. 7 is an enlarged fragmentary perspective view, broken away in part, of the left half of the casing of the apparatus shown in FIG. 4.
Figure 9A:
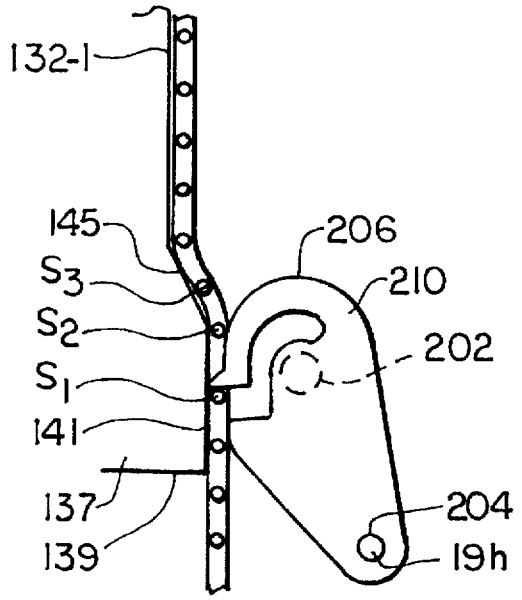
FIG. 9*a*, 9*b*, 9*c*, and 9*d* are schematics of the steps in advancing a fastener clip in the guide groove of the apparatus in FIG. 4, showing the feed member, the projection and a portion of the front wall of the guide groove of the apparatus shown in FIG. 4.
Figure 9B:
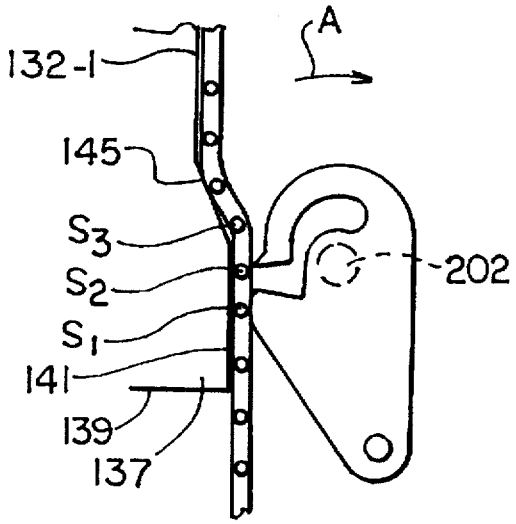
Figure 9C:
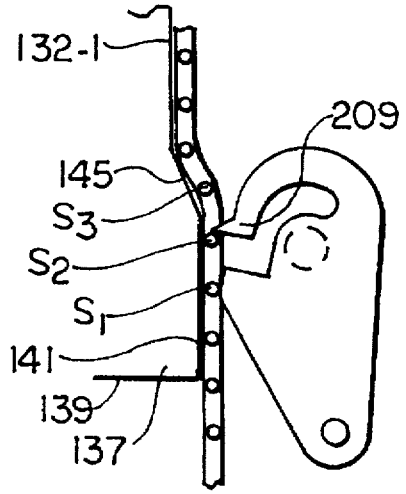
Figure 9D:
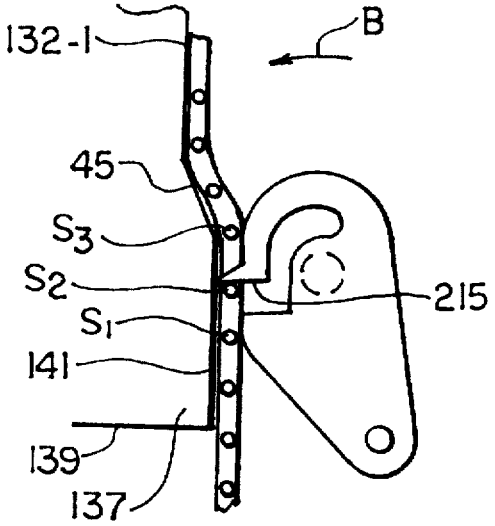

As shown in FIGS. 6 through 7, protrusion 137 comprises a bottom surface 139, a side surface 141 and a tapered top surface 145. Protrusion 137 has a width W at its untapered portion of about 0.015 inches and extends into guide groove 127 such that side surface 141 is in approximate alignment with the center axis of stub receiving portion 131.

Bottom surface 139 of protrusion 137 is positioned directly above inlet opening 123 of needle 117. The length l of protrusion 137 is approximately 0.10 inches, which corresponds to the length of a little more than two successive fasteners 13 in most types of fastener stock 11. As can be seen in FIG. 7, the width $W_2$ of fastener stock 11 is considerably less than the width $W_3$ of stub receiving portion 131 of guide groove 127. Consequently, stock 11 can move from the front to the rear in groove portion 131 as shown by arrows A in FIG. 6B as it moves down in groove portion 131.

Apparatus 101 further comprises a variable pitch feed member 201 and a location member 301. Elements 201 and 301 cooperate to provide for the reliable advancement of fastener stock 11 into apparatus 101. More particularly, elements 201 and 301 provide for the proper positioning of the cross-bar of the lowermost fastener in fastener stock 11 down into alignment with inlet opening 123, thereby enabling said fastener to be dispensed through needle 117 by ejector rod 126. Both feed member 201 and location member 301 are of the type described in U.S. Pat. No. 4,651,913 to Bone.

Figure 8A:
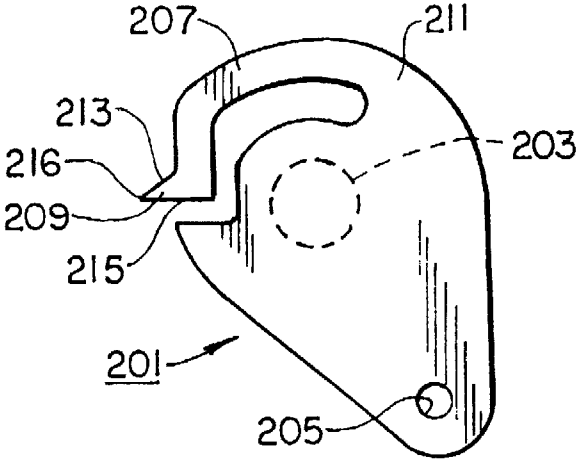
FIG. 8*a* and 8*b* are a front and side views of the feed member of FIG. 5.
Figure 8B:
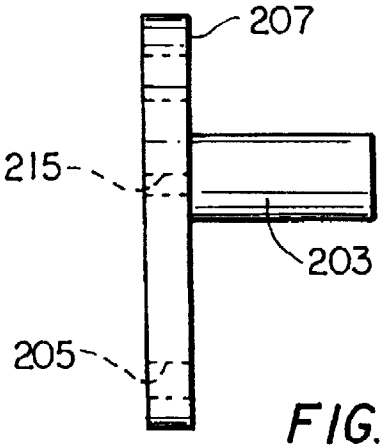

Referring now to FIGS. 8*a* and 8*b*, there are shown front and side views, respectively, of feed member 201. Feed member 201 comprises a pivot pin 203, a link aperture 205, and a finger 207 having a tooth 209. Feed member 201 is preferably fabricated from a resilient wear resistant material, such as NYLON or AN ACETAL RESIN. Pivot pin 203 serves as the fixed pivot point of feed member 201. Aperture 205 serves as the means for coupling feed member 201 to a linking rod 151 which, in turn, is coupled to a slide 153 positioned directly underneath ejector rod 126. As linking rod 151 is advanced forward via slide 153, feed member 201 is pivoted about the axis of pin 203. Linking rod 151 provides a low resistance, low wear connection to feed member 201. Control lever 116 is responsible for moving slide 153 forwards and backwards within apparatus 101, slide 153 traveling parallel to the path traveled by ejector rod 126.

Finger 207 of feed member 201 has a curved profile, and is integrally formed from the feed member body 211. Tooth 209 has an upper surface 213 and a lower surface 215. Upper surface 213 and lower surface 215 intersect to form a tip 216, surfaces 213 and 215 intersecting at tip 216 at an angle of approximately 30 to 45 degrees.

Protrusion 137 and variable pitch feed member 201 together serve to effectively advance and position the cross-bar of the lowermost fastener in fastener stock 11 down into alignment with inlet opening 123 of needle 117 for ejectment.

As can be seen in FIG. 9(*a*), tooth 209 is disposed above stub $S_1$, which was previously coupled to the lowermost fastener in the fastener stock, the lowermost fastener having since being ejected through needle 117 by ejector rod 126. After the lowermost fastener has been expelled through needle 117, control lever 116 contacts a front post 154-1 on slide 153, thus urging linking rod 151 forwards. Forward movement of linking rod 151 causes feed member 201 to rotate about pivot 203. Rotation of feed member 201 causes finger 207 to bend inwardly as tooth 209 is pushed back by the next succeeding stub $S_2$, as shown in FIG. 9(*b*). Due to the angle of upper surface 213, tooth 209 easily slides over stub $S_2$. As feed member 201 continues to rotate, tooth 209 moves in a direction tangential to the direction in which the assemblage is fed, shown by arrow A in FIG. 9(*b*). The rotation of feed member 201 thus causes tooth 209 to become free of stub $S_2$, whereupon finger 207 springs forward disposing tooth 208 between stub $S_2$ and the next succeeding stub $S_3$, as shown in FIG. 9(*c*).

Control lever 116 next reverses direction as trigger 115 is released, control lever pushing back on a rear post 154-2 on slide 153. As a result, linking rod 151 is drawn back, causing feed member 201 to rotate about pivot 203 in an opposite direction, as shown by counterclockwise arrow B in FIG. 9(*d*). Lower surface 215 of tooth 209 then contacts the upper side of stub $S_2$, urging its associated cross-bar down into alignment with inlet opening 123 for ejectment as feed member 201 continues to pivot counterclockwise, as shown in FIGS. 9(*c*) and 9(*d*). The cycle is repeated each time the trigger is depressed and released.

Figure 6B:
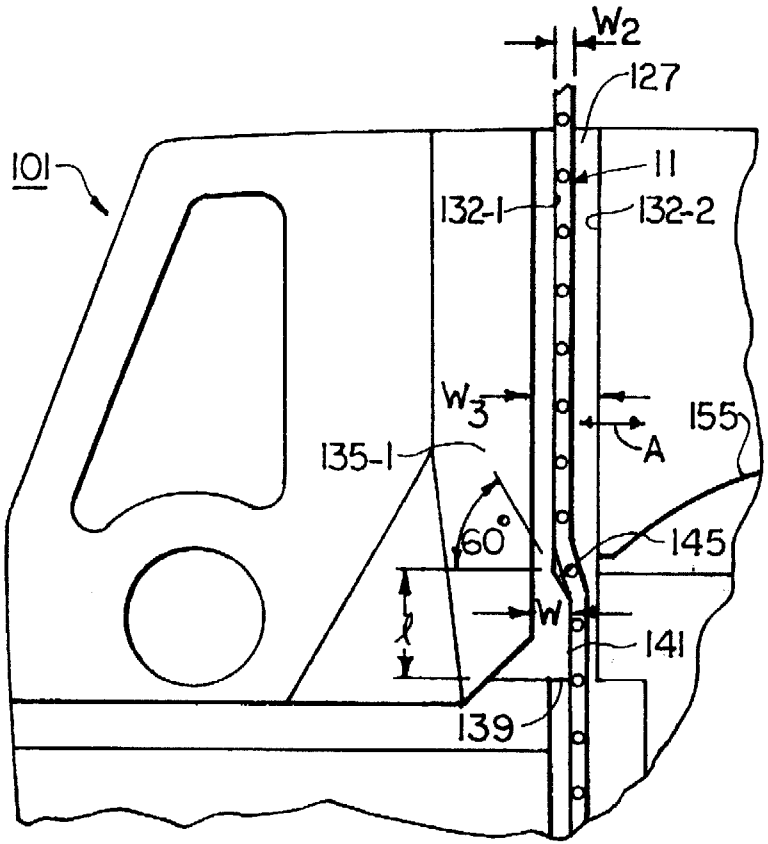
FIG. 6B is an enlarged fragmentary view of the left half of the casing shown in FIG. 4 with a fastener clip installed.
Figure 6A:
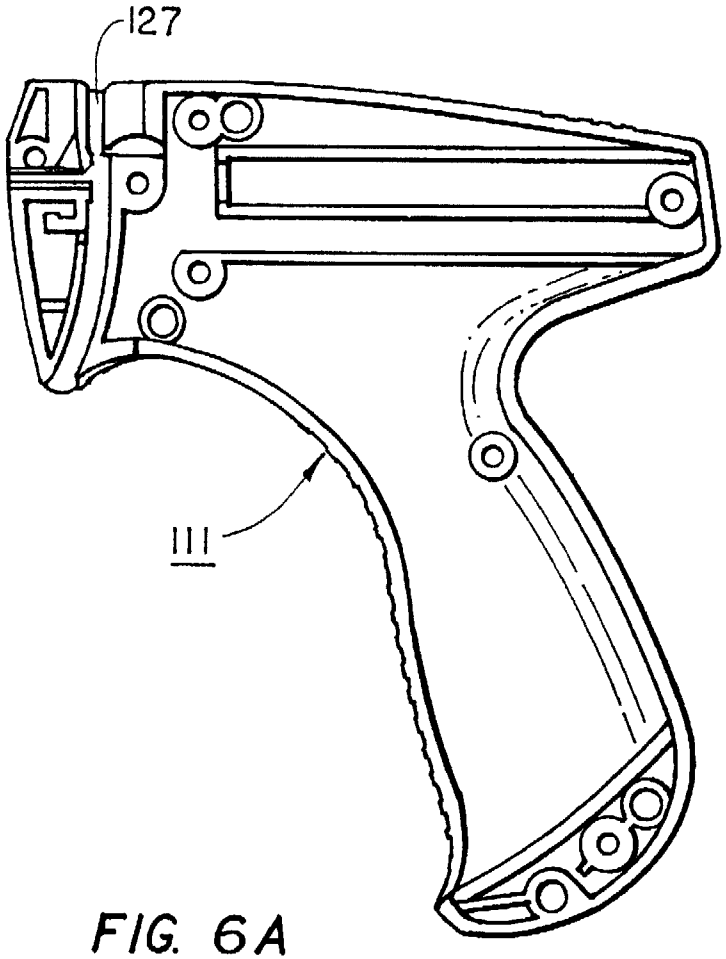
FIG. 6A is a side elevation view of the left half of the casing of the apparatus shown in FIG. 4.

Particular significance must be drawn to the function of protrusion 137 during the counterclockwise rotation of feed member 201, in particular, when tooth 209 urges the associated cross-bar of stub $S_2$ down in position for ejectment through needle 117. As shown in FIG. 6B, protrusion 137 serves to position the lowermost stubs of fastener stock 11 in towards the center axis of stub receiving groove 131. Positioning the lowermost stubs towards the center axis of stub receiving portion 131 of guide groove 127 ensures that stub $S_2$ is situated directly underneath lower surface 215 of tooth 209 as feed member 201 pivots. Having stub $S_2$ situated directly underneath tooth 209, away from tip 216, during the counterclockwise rotation of feed member 201 ensures that tooth 209 displaces the associated cross-bar of stub $S_2$ straight down into alignment with inlet opening 123 of needle 117 for ejectment.

As can be appreciated, in the absence of protrusion 137, oftentimes the lowermost stubs of fastener stock 11 could become positioned along front wall 132-1 of stub receiving portion 131. As a consequence, when feed member 201 is rotated counterclockwise to advance the lowermost fastener in line with needle 117, stub $S_2$ would be aligned at tip 216 of tooth 209, rather than directly underneath lower surface 215 of tooth 209, away from tip 216, as desired. With stub $S_2$ positioned at tip 216 of tooth 209, tooth 209 would tend to push stub $S_2$ down as well as in towards front wall 132-1. Displaced at such an angle, stub $S_2$ could become wedged in between tip 216 and front wall 132-1. Wedged as such, feed member 201 could no longer advance the associated cross-bar of stub $S_2$ directly down and in line with inlet opening 123 of needle 117 as required for proper ejectment. Instead, with stub $S_2$ wedged between tooth 209 and front wall 132-1, the apparatus would become jammed, precluding further use.

Finger 207 is highly susceptible to damage in use. As a consequence, finger 207 is integrally formed from the feed member body 211, causing the bending force to be distributed over an extended area, as opposed to a particular point. Moreover, apparatus 101 is provided with a curved ridge 155 matable with the curved profile of finger 207. Finger 207 is greatly strengthened by buttressing finger 207 with ridge 155 as well as projection 137. Ridge 155 and projection 137 both serve to support tooth 209 during the rotation of feed member 201.

Ejection location member 301 is provided to prevent fastener stock 101 from moving upwards during cycling of feed member 201. Location member 301 is of the type disclosed in U.S. Pat. No. 4,651,913 to Bone. Location member 301, also commonly referred to as an anti-back mechanism, applies a constant downward force on the lowermost fastener in fastener stock 11 to ensure the proper downward advancement of fastener stock 11 through apparatus 101.

The embodiment of the present invention described above is intended to be merely exemplary and those skilled in the art shall be able to make numerous variations and modifications to it without departing from the spirit of the present invention. All such variations and modifications are intended to be within the scope of the present invention as defined by the appended claims.

What is claimed is:

1. An apparatus for dispensing plastic fasteners from a clip of fastener stock, the clip of fastener stock comprising a plurality of individual fasteners, each individual fastener having a cross bar coupled to a common runner bar by a stub, said apparatus comprising:

a casing, a hollow needle mounted on said casing, said hollow needle having an inlet opening and an outlet opening, a guide groove formed in said casing for receiving the fastener stock, said guide groove being in communication with the inlet opening of said hollow needle, said guide groove having a stub receiving portion, said stub receiving portion being bounded by a front wall, a feed member mounted on said casing, said feed member comprising a tooth having a lower surface, said tooth being engageable with the stub of an individual fastener to advance the fastener stock loaded into said guide groove so that the cross bar of a fastener to be dispensed is advanced into alignment with the inlet opening of said hollow needle, a protrusion on the front wall of the stub receiving portion of said guide groove, said protrusion laterally positioning the stub of the individual fastener into engagement with the tooth of said feed member such that the stub lies entirely underneath the lower surface of the tooth when said feed member advances the fastener stock, and an ejector rod for pushing the cross bar of the fastener to be dispensed out through the outlet opening of said needle.

2. The apparatus as claimed in claim 1 wherein said protrusion positions the stub of the individual fastener in engagement with the tooth of said feed member underneath an approximate center of the lower surface of the tooth when said feed member advances the fastener stock.

3. The apparatus as claimed in claim 2 wherein said protrusion is at a bottom of said front wall.

4. The apparatus as claimed in claim 3 wherein said protrusion includes a tapered top surface.

5. The apparatus as claimed in claim 4 wherein said protrusion is positioned directly above the inlet opening of said needle.

6. The apparatus as claimed in claim 5 wherein said guide groove is vertically disposed and said protrusion has a tapered portion and a vertical portion.

* * * * *